United States Patent [19]

Hudson, Jr.

[11] Patent Number: 4,578,823

[45] Date of Patent: Apr. 1, 1986

[54] SAFETY HAND PROTECTOR

[76] Inventor: William E. Hudson, Jr., 2971 Fleetbrook Dr., Memphis, Tenn. 38116

[21] Appl. No.: 624,141

[22] Filed: Jun. 25, 1984

[51] Int. Cl.[4] ..... A41D 13/08; A41D 27/00

[52] U.S. Cl. ..... 2/16; 2/273

[58] Field of Search ..... 2/16, 17, 160, 167, 2/273

[56] References Cited

U.S. PATENT DOCUMENTS 1,085,897 2/1914 Feld ..... 2/273

3,570,009 3/1971 Spruell ..... 2/16

*Primary Examiner*—Doris L. Troutman

*Attorney, Agent, or Firm*—William F. Frank

[57] ABSTRACT

The present invention is a two-part interconnected protecting device which when properly used will enable the user to release a pressure cap or close a valve while simultaneously preventing the hot spraying fluid from striking the user. The first part is a hand protector of a heat-resistant, water-impermeable material. The second part is a circular skirt of preferably the same type of material which is secured to the base of the hand protector.

8 Claims, 4 Drawing Figures

SAFETY HAND PROTECTOR

FIELD OF THE INVENTION

The present invention is in the field of personal safety devices. More particularly, the present invention is a hand protector for those who must handle valves and the like on apparatus through which hot pressurized fluids pass.

BACKGROUND OF THE INVENTION

One of the more hazardous circumstances than can befall an automobile driver or a service station attendant or mechanic is a failure in the cooling system of an automobile engine. Water pump failure, broken drive belt for the water pump, failure in a hose between the radiator and the engine block, failure in a heater hose, failure in the head gasket, anyone of which results in the overheating of the coolant. Not only is the temperature of the coolant raised to the boiling point, but superheated steam is generally created with attendant high pressure. The best remedy for such a situation is to relieve the pressure, and the simplest step, but most dangerous, is to open or at least back off the pressure cap for the radiator. Not only is the cap hot to the touch but the internal pressure in the radiator requires downward pressure on the cap greater than normally is necessary to open the cap under good operating conditions. Standard procedure for the driver or attendant is to grab some cloths, place them over the cap, press down while turning and hope for the best while jumping back out of the way. If the cap is turned sufficiently to release the pressure, the pressurized fluid sprays out from under the cap in any and all directions. If the cap is turned too far, the cap is blown off the radiator filler spout, and a small geyser of hot fluid and steam streams upwardly, usually striking the underside of the raised hood from which it is sprayed outwardly indiscriminately. It is not uncommon for the driver or attendant to have to make more than one attempt to relieve the pressure, resulting in additional heating of the cloths being used and enhancing the opportunity for burning the hand. If the pressure cap is relieved, the cloths offer little protection from the spraying fluid. A leather glove in conjunction provides more protection from the hot cap but not from the heated fluid.

Many industrial operations involve the passage of hot fluids through conduits and valves. If a break occurs in a valve body, closing the valve may stop the outward spraying of the fluid. A hot valve is like a hot pressure cap. If a break occurs in a conduit, it is necessary to close the valve upstream of the break, and the valve may again be too hot to the touch.

Until the present invention there was no known hand protector which could be used in any of the foregoing situations which would provide safety to the person attempting to remedy the situation.

SUMMARY OF THE INVENTION

The present invention is a two-part interconnected protecting device which when properly used will enable the user to release a pressure cap or close a valve while simultaneously preventing the hot spraying fluid from striking the user. The first part is a hand protector of a heat-resistant water-impermeable material. The second part is a circular skirt of preferably the same type of material which is secured to the base of the hand protector.

BRIEF DESCRIPTION OF THE DRAWINGS

The present invention is illustratively shown in the accompanying drawings in a preferred embodiment.

DETAILED DESCRIPTION OF THE INVENTION

Figure 1:
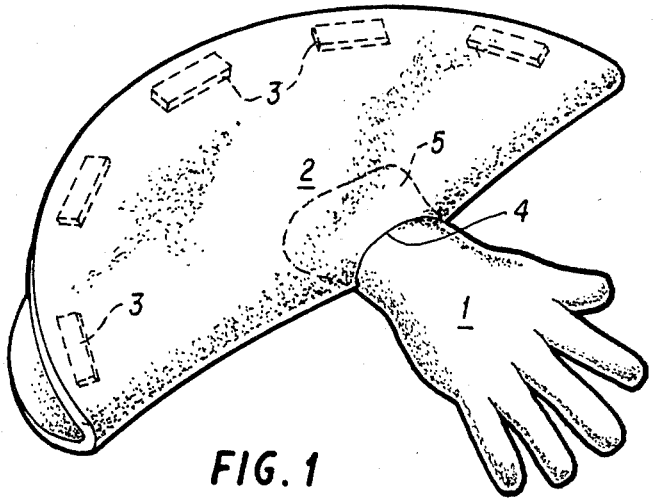
FIG. 1 is a plan view of the present invention, the opposite side being substantially identical.

With reference to FIG. 1, the hand protector 1 is shown as a conventional glove shape, this having a somewhat curved form and generally requiring a slightly different shape for the left hand. The hand protector may be in the shape of uni-hand glove, also well-known, which can be worn on either hand with equal facility. The hand protector may also have the shape of a mitten. The hand protector is made of any commercially available thermoplastic material having a high heat resistant quality surface and interior. The hand protector may be molded from this material or may be coated over a cloth glove for ease in production. The hand protector 1 includes a cuff 5 which may be of the same material or may be the cloth inner glove referred to above.

Figure 2:
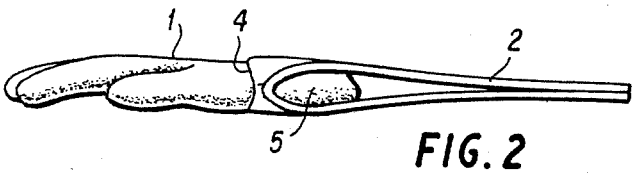
FIG. 2 is a side view of the invention in FIG. 1.
Figure 3:
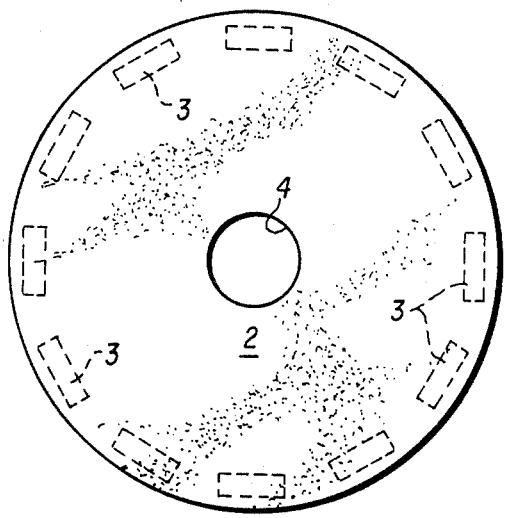
FIG. 3 is a plan view of the skirt part of the present invention, the opposite side being substantially identical.

As seen in FIGS. 1–3, the second part of the invention is a circular skirt 2 having a plurality of weights 3 around the periphery and a central opening 4 into which the hand protector 1 is inserted and secured thereto in any well-known manner which will provide integrity between the skirt and the hand protector. The skirt 2 is made from a waterproof, heat-resistant material having sufficient flexibility so that when the invention is placed over a radiator the skirt will drape itself over the front and back of the radiator and along the top thereof. The draping of the skirt is enhanced by the weights 3 which also prevent the skirt from being lifted up by the pressurized fluid when the pressure cap is released.

Figure 4:
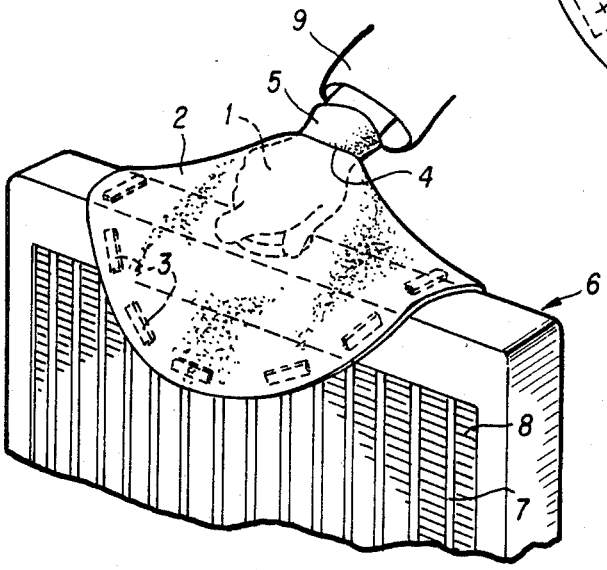
FIG. 4 is a perspective view of the present invention positioned on a radiator to open the pressure cap.

Use of the present invention is illustrated in FIG. 4 wherein the invention has been placed over the pressure cap (not shown) of a radiator 6 having fluid cores 7 and cooling fins 8. The user, represented by arm 9, has placed the hand protector on the cap and the skirt 2 has been draped over the front and back of the radiator core. The user grasps the pressure cap with the hand protector 1, presses down on the cap to release it from its normally locked position and turns the cap to its safety stop, thus allowing the hot coolant to begin to escape. The escaping fluid strikes the draped skirt which deflects the fluid to run down the front and back faces of the radiator. When the pressure has been relieved to the point that the coolant is no longer spraying out from the cap, the cap may be removed or left in place and the present invention removed from the radiator.

It should be apparent that the procedures outlined above are applicable to situations involving valves and conduits in industrial processes discussed previously.

While the skirt 2 of the present invention has been initially described as being circular, it will be apparent to those of skill in the art that other appropriate geometric shapes may be employed. It has been found that the minimum diameter or width should be not less than 18" for minimal desired protection. The manner in which the weights 3 are secured to the skirt is primarily a production decision. The important aspect of the weights is the weight they impart to the skirt. Pressurized cold water tests indicate that the minimum total weight should not be less than 3 pounds. It is to be noted that the skirt is secured to the hand protector portion at the juncture of the hand protector per se and the cuff.

I claim:

1. A protective device for at least releasing the pressure in an overheated cooling system for combustion engines comprising a hand protector of a waterproof, high temperature-resistant material and a skirt of flexible, shapeless waterproof, high temperature resistant material secured to the base of the hand protector, the skirt having a plurality of weights spacedly attached around the periphery of said skirt.

2. The device according to claim 1 wherein said hand protector has a cuff extending from the base of said protector interiorly of said skirt.

3. The device according to claim 2 wherein said hand protector is in the shape of a glove.

4. The device according to claim 3 wherein said hand protector is in the shape of a mitten.

5. The device according to claim 3 wherein said glove is in the form of a uni-hand glove.

6. The device according to claim 1 wherein said skirt is circular with a diameter of at least 18 inches.

7. The device according to claim 1 wherein the total of said weights is at least 3 pounds.

8. A protective device for at least releasing the pressure in a radiator of an overheated cooling system for combustion engines comprising a hand protector of a waterproof, high temperature-resistant material to grasp and release said radiator pressure cap and a skirt of flexible, waterproof, high temperature-resistant material secured to the base of the hand protector, the skirt having a plurality of weights spacedly attached around the periphery of said skirt, said material having sufficient flexibility and length to drape itself over and in contact with the front and back surfaces of the upper portion of said radiator and lay along the top surface thereof.

* * * * *